United States Patent [19]

Camarda et al.

[11] Patent Number: 4,838,346

[45] Date of Patent: Jun. 13, 1989

[54] REUSABLE HIGH-TEMPERATURE HEAT PIPES AND HEAT PIPE PANELS

[75] Inventors: Charles J. Camarda, Virginia Beach; Philip O. Ransone, Hayes, both of Va.

[73] Assignee: The United States of America as represented by the Administrator of the National Aeronautics and Space Administration, Washington, D.C.

[21] Appl. No.: 237,036

[22] Filed: Aug. 29, 1988

[51] Int. Cl.[4] ..... F28D 15/02; F28F 19/02

[52] U.S. Cl. ..... 165/104.14; 165/41; 165/133; 165/180; 165/905

[58] Field of Search ..... 165/104.14, 133, 180, 165/905, 185, 41

[56] References Cited

U.S. PATENT DOCUMENTS 3,640,517 2/1972 Sendt ..... 165/104.26
3,710,572 1/1973 Herud ..... 165/185
3,913,666 10/1975 Bayliss ..... 165/185
4,478,275 10/1984 Ernst ..... 165/180

*Primary Examiner*—Albert W. Davis, Jr.
*Attorney, Agent, or Firm*—George F. Helfrich; John R. Manning; Charles E. B. Glenn

[57] ABSTRACT

A reusable, durable heat pipe which is capable of operating at temperatures up to about 3000° F. in an oxidizing environment and at temperatures above 3000° F. in an inert or vacuum environment is produced by embedding a refractory metal pipe within a carbon-carbon composite structure. A reusable, durable heat pipe panel is made from an array of refractory-metal pipes spaced from each other, each refractory-metal pipe being embedded within a carbon-carbon composite structure. The reusable, durable, heat-pipe panel is employed to fabricate a hypersonic vehicle leading edge and nose cap.

6 Claims, 2 Drawing Sheets

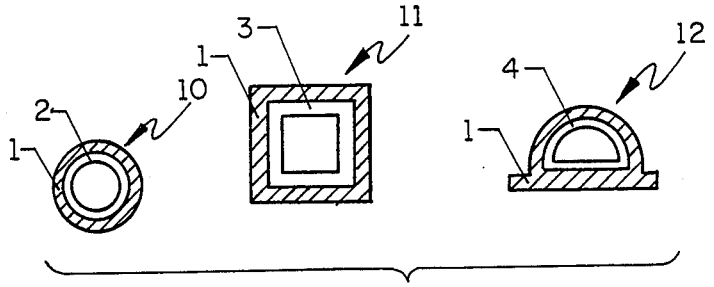
FIGURE 1
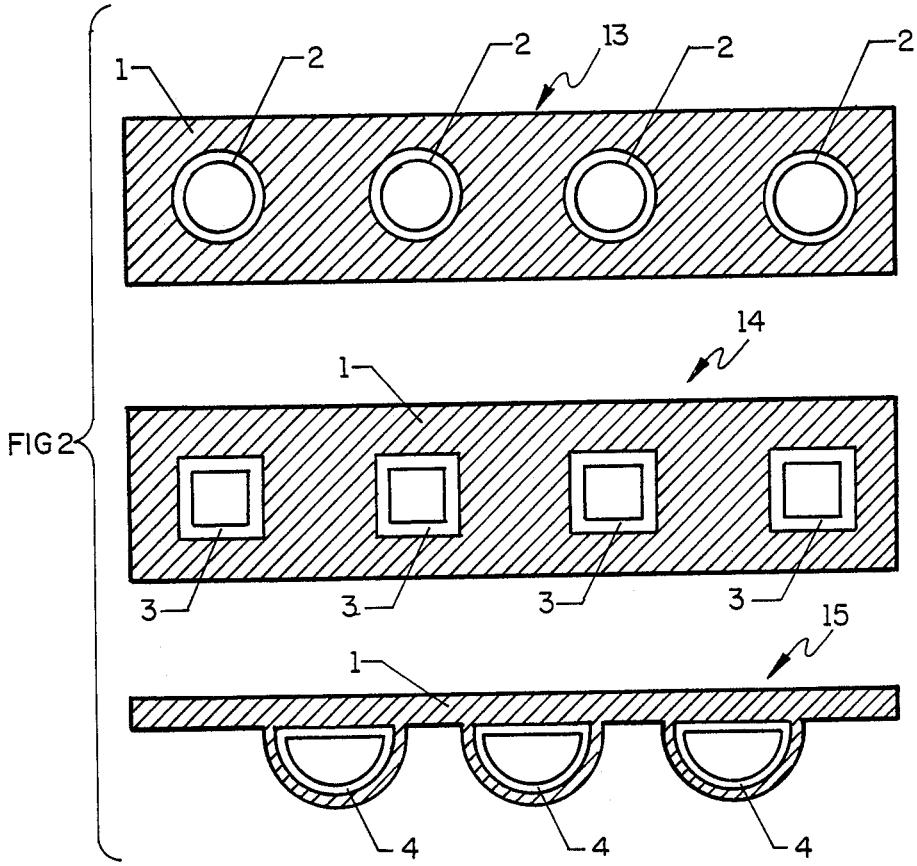

REUSABLE HIGH-TEMPERATURE HEAT PIPES AND HEAT PIPE PANELS

ORIGIN OF THE INVENTION

The invention described herein was made by employees of the United States Government and may be manufactured and used by or for the Government for governmental purposes without the payment of any royalties thereon or therefor.

BACKGROUND OF THE INVENTION

1. Field of the Invention

The present invention relates generally to high temperature heat pipes. It relates in particular to reusable, durable heat pipes which are capable of operating at temperatures up to about 3000° F. in an oxidizing environment and has applications above 3000° F. in an inert or vacuum environment.

2. Prior Art

High-temperature heat pipes have been fabricated and operated in oxidizing environments at temperatures below about 2700° F. Most of these heat pipes use refractory metal containers which are coated externally with an oxidation resistant coating. The coating is usually a ceramic material which typically has a low tensile strength and a low coefficient of thermal expansion. The state-of-the-art in high-temperature heat pipes uses tungsten, molybdenum, or some other refractory-metal heat pipe with an external disilicide coating for oxidation resistance. The coating is very fragile and is limited in use beyond temperatures of about 2700° F. The coating must withstand the thermal stresses produced from differences in thermal expansion of the refractory metal and the ceramic coating.

The disadvantages of the prior art are:

1. Currently, the maximum use temperature for heat pipes in an oxidating environment is 2700° F.

2. Oxidation resistant coatings are fragile and susceptible to cracking, impact, thermal stress, and erosion problems. Once the coating is damaged, the refractory-metal heat-pipe container is exposed and can oxidize very rapidly at temperatures above 2700° F.

a. For leading edge and nose cap applications on hypersonic vehicles, this could lead to a catastrophic vehicle failure.

b. For waste heat recovery applications, this could severely limit the life of the system.

3. Structural loads are withstood entirely by the refractory metal heat-pipe container. The ceramic coating serves no structural function other than oxidation resistance. Since refractory metals are typically very heavy compared to ceramic materials, the resulting heat pipe designs are heavy; and mass is a very important consideration in many applications, especially in hypersonic vehicles.

4. Ceramic coatings have very low thermal conductivities and, hence, degrade the efficiency of the heat-pipe in rejecting heat. Outer surface temperatures are a function of the overall thermal resistance of the heat pipe system.

Accordingly, it is the primary object of the present invention to develop a reusable, durable heat-pipe which can operate at temperatures up to about 3000° F. in an oxidizing environment and has applications at temperatures above 3000° F. for insert or vacuum environments. Applications of this invention are many and include: cooling stagnation regions of hypersonic vehicles (leading edges and nose caps), cooling nozzle and throat areas of jet and rocket designs, waste heat recovery from nuclear and fossil fuel plants, and thermally inert structures such as space antennas, mirrors, laser platforms, and telescopes. The primary application for the present invention is to cool leading edges and nose caps of hypersonic vehicles, which requires the use of an oxidation resistant surface.

SUMMARY OF THE INVENTION

The reusable, durable heat-pipe of the present invention comprises a refractory-metal pipe which is embedded within a carbon-carbon composite structure.

BRIEF DESCRIPTION OF THE DRAWINGS

For a more complete understanding of the present invention, including its primary object and attending benefits, reference should be made to the Description of the Preferred Embodiments, which is set forth below. This description should read together with the accompanying drawing, wherein:

FIG. 1 schematically shows a reusable, durable heat pipe according to the present invention in cross section with respect to three preferred embodiments thereof;

FIG. 2 schematically shows a reusable durable heat pipe panel according to the present invention in cross section with respect to three preferred embodiments thereof;

DESCRIPTION OF PREFERRED EMBODIMENTS

Figure 3:
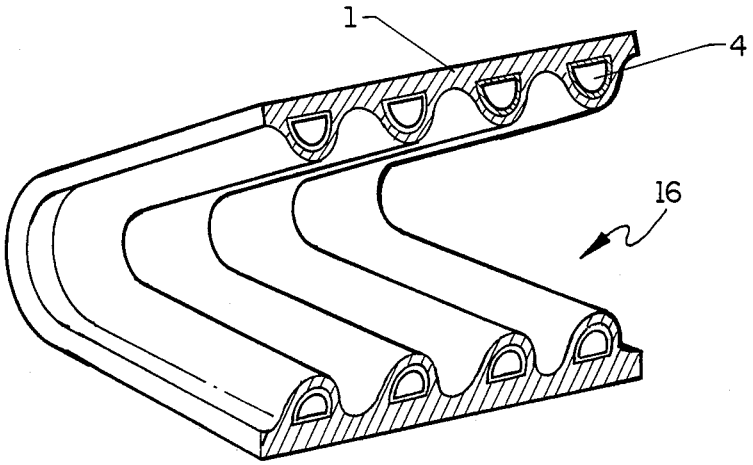
FIG. 3 schematically depicts a section of a hypersonic wing leading edge which is fabricated from one of the reusable, durable heat pipe panels of FIG. 2.

Carbon-carbon is a composite material which is lightweight, has structural integrity above 3000° F., and whose mechanical and thermophysical properties can be tailored in all directions. The carbon-carbon material is made from carbon fibers which are pyrolyzed from a precursor fiber such as rayon or polyacrylonitrile (PAN). The fibers are then impregnated with a carbonaceous resin system such as furfuryl alcohol or phenolic resin and repyrolyzed several times to increase the strength and density of the material while subsequently reducing the porosity. In general, the PAN precursor is stretched about 80% either prior to or during stabilization, a cycle which involves heating the fiber at 200° C. for twenty-four hours in air. Carbonization, the next phase, consists of slowly heating the fiber in an inert atmosphere to 1000° C. The fibers are then graphitized by raising the temperature to the desired heat treatment temperature, usually ranging from 1000° C. to 2500° C. Elastic moduli, strengths, and thermal conductivities can be varied by varying the heat treatment of the fibers and by varying the fiber weave pattern.

Heat pipes, according to the present invention, can be fabricated individually (see FIG. 1) or as a flat or curved panel (see FIG. 2) by placing several lamina or layers of a woven graphite cloth about one or more refractory-metal pipes and following the fabrication steps for a carbon-carbon component. These steps include impregnating the cloth with a resin material (usually phenolic) and mold-curing under pressure to form a carbon-phenolic composite. The molded part is then pyrolized to reduce the resin to a carbon char matrix. The resultant part is porous and must be densified by multiple resin re-impregnations and pyrolysis, or by other means such as chemical vapor infiltration (CVI). The densification process is repeated the required number of times to achieve the desired density and strength of the carbon-carbon material. The carbon-carbon must then be coated with an oxidation protection coating. An oxidation protection coating for carbon-carbon usually consists of a silicon-based material such as silicon carbide, which itself oxidizes to form a glassy seal at operating temperatures. For applications at 3000° F., sophisticated coatings are always required which consist of silicon-based materials such as carbides, and oxides. The refractory heat pipes can be coated externally to prevent excessive carbide formation, if necessary, and they can be serviced with a wick and suitable working fluid prior to being embedded in the carbon-carbon. The wick can be manufactured from a refractory metal in any of several configurations (woven screen mesh, sintered metal, artery, etc.), and the working fluid can be any high-temperature fluid which is compatible with refractory metals (i.e. potassium, sodium, lithium, etc.). A three-dimensional (3-D) graphite fiber weave can be used to increase the interlaminar strength and thermal conductivity of the carbon-carbon. The refractory-metal pipes can then be inserted into the woven mesh and cured as described above. Various fabrication methods such as the 3-D weave are sometimes necessary to overcome potential thermal stress problems and to reduce thermal gradients in the heat pipe. Refractory metals which are suitable in the fabrication of the pipes and wicks referred to above are tungsten, molybdenum, rhenium and columbium.

Figure 4:
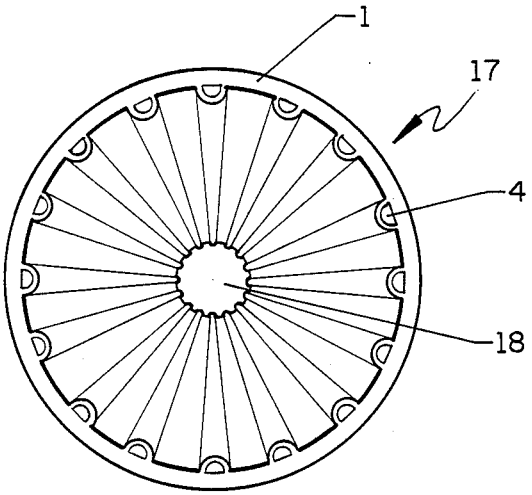
FIG. 4 schematically depicts the interior of a hypesonic vehicle nose cap which is fabricated from one of the reusable, durable heat pipe panels of FIG. 2.

The primary application of the carbon-carbon/refractory metal heat pipe of the present invention is to cool the leading edge 16 and nose cap 17 regions of hypersonic vehicles (see FIGS. 3 and 4). For many hypersonic vehicles, trajectories, geometries, etc. the temperature at the stagnation region along the leading edges and nose cap can greatly exceed the use temperatures of most materials. To alleviate the problem some form of cooling is required. Instead of an active means of cooling which is complex and heavy, a heat pipe, according to the present invention, provides a passive means of cooling. Such a heat pipe can cool the stagnation regions by transporting the heat to cooler aft sections of the wing or fuselage, raising the temperature there above the radiation equilibrium temperature, and thus rejecting the heat by radiation to free space. The maximum structural re-use temperatures for most refractory metals is about 2400° F., and for carbon-carbon it is 3000° F. Carbon-carbon alone could not contain a working fluid and, hence, could not be fabricated into a heat pipe, According to the present invention, thin refractory metal pipes are embedded in the carbon-carbon. Heat is rejected at 3000° F. instead of at 1800° F. if superalloy pipes are used, and at 2400° F. for coated, refractory heat pipes. The increase in operating temperature of heat pipes, according to the present invention, greatly reduces the surface area needed for radiation, and thereby greatly reduces the mass of the system. The high thermal conductivity of the graphite fibers helps to reduce local peak temperatures, and the graphite also offers ablation protection in the event of a heat pipe failure.

FIG. 1 shows examples of indivdiaul heat pipes 10, 11, and 12 according to the present invention, which are made by embedding refractory-metal pipes 2, 3, and 4, respectively in carbon-carbon composite 1. FIG. 2 illustrates some possible configurations 13, 14, and 15 of heat pipe panels according to the present invention, which are fabricated from spaced arrays of refractory-metal pipes 2, 3, and 4, respectively, all of which are embedded within carbon-carbon composite 1. Any of the panels 13, 14, and 15 may be used to fabricate the hypersonic vehicle wing leading edge 16 of FIG. 3 and the hypersonic vehicle nose cap 17 of FIG. 4. It is particularly noted that hypersonic vehicle nose cap 17 includes a heat-pipe vapor chamber 18, which is positioned at the tip of nose cap 17 within carbon-carbon composite 1 and communicates with each of the individual refractory-metal pipes 4 which are embedded in carbon-carbon composite 1. Since the refractory metals have close to the same coefficient of thermal expansion as carbon-carbon, the possibility of excessive thermal stresses is reduced.

Alternate applications of the heat pipes and heat pipe panels of the present invention include waste heat recovery from fossil or nuclear fuel power plants, high temperature radiators for rejecting heat in space, and cooling the throat and/or nozzle section of jet or rocket engines. In addition, for distortion-free structures which experience thermal loading and temperature gradients, the carbon-carbon heat pipes of the present invention offer a potential solution. The heat pipes help to eliminate any thermal gradients and the materials themselves (refractory metals and carbon-carbon) have very low coefficients of thermal expansion. Thus, carbon-carbon/refractory metal heat pipes offer the potential for thermally inert structures, and can be used for applications such as space antennas, mirrors, lasers, and telescopes.

The advantage of the present invention over the prior art are:

1. The current invention operates at higher temperatures (up to about 3000° F. in an oxidizing environment and at higher temperatures in an inert or vacuum environment).

2. Heat pipes, according to the present invention, operate at much higher temperatures in an oxidizing environment. They radiate heat way at much higher rates and, thus, reduce the area needed for heat rejection from a nose cap or wing leading edge. This also results in a lower mass for the system.

3. The carbon-carbon structure offers fail-safe protection for hypersonic vehicle nose cap or leading edge applications. In the event of a heat pipe failure, an over temperature would result and cause an ablation/oxidation of the carbon-carbon. This could allow sufficient time for the vehicle to land.

4. Carbon-carbon is lightweight and has good structural properties at high temperatures. This affords a lightweight design.

5. Both carbon-carbon and refractory metals have low coefficients of thermal expansion and hence experience minimal thermal distortions. The use of such heat pipes would enable the development of a thermally inert structure.

6. A carbon-carbon/refractory metal heat pipe is much more durable and lighter than a disilicide coated refractory-metal heat pipe.

What is claimed is:

1. A reusable, durable heat pipe which is capable of operating at temperatures up to about 3,000° F. in an oxidizing environment and at temperatures above 3000°

F. in an inert or vacuum environment, which comprises a refractory metal pipe embedded within a carbon-carbon composite structure.

2. The reusable, durable heat pipe of claim 1, wherein the refractory metal is selected from the group consisting of: tungsten, rhenium, columbium and molybdenum.

3. A reusable, durable heat pipe panel which is capable of operating at temperatures up to about 3000° F. in an oxidizing environment and at temperatures above 3000° F. in an inert or vacuum environment, which comprises an array of refractory metal pipes spaced from each other, each refractory metal pipe being embedded within a carbon-carbon composite structure.

4. The reusable, durable heat pipe panel of claim 3, wherein the refractory metal is selected from the group consisting of: tungsten, rhenium, columbium and molybdenum.

5. A hypersonic vehicle nose cap fabricated from the reusable, durable heat pipe panel of claim 4.

6. A hypersonic vehicle wing leading edge fabricated from the reusable, durable heat pipe panel of claim 4.

* * * * *